US010262815B2

(12) United States Patent
Yuan

(10) Patent No.: US 10,262,815 B2
(45) Date of Patent: Apr. 16, 2019

(54) BUTTON LOCKING DEVICE

(71) Applicant: Dongguan ChongWei Metals & Plastic Products Factory Co., Ltd., Dongguan (CN)

(72) Inventor: Mengxiao Yuan, Dongguan (CN)

(73) Assignee: Dongguan Chongwei Metals & Plastic Products Factory Co., Ltd., Dongguan (CN)

( * ) Notice: Subject to any disclaimer, the term of this patent is extended or adjusted under 35 U.S.C. 154(b) by 0 days.

(21) Appl. No.: 15/703,595

(22) Filed: Sep. 13, 2017

(65) Prior Publication Data

US 2018/0082802 A1 Mar. 22, 2018

(30) Foreign Application Priority Data

Sep. 20, 2016 (CN) ..... 2016 1 0834101

(51) Int. Cl.

| | |
|---|---|
| ***H01H 13/14*** | (2006.01) |
| ***H01H 13/20*** | (2006.01) |
| ***H01H 13/52*** | (2006.01) |
| ***H01H 13/83*** | (2006.01) |
| ***E05B 65/52*** | (2006.01) |
| ***E05B 13/00*** | (2006.01) |
| *E05B 47/00* | (2006.01) |

(52) U.S. Cl.

CPC ..... *H01H 13/14* (2013.01); *E05B 13/002* (2013.01); *E05B 65/52* (2013.01); *H01H 13/20* (2013.01); *H01H 13/52* (2013.01); *H01H 13/83* (2013.01); *E05B 47/0012* (2013.01); *H01H 2013/525* (2013.01)

(58) Field of Classification Search

CPC ..... H01H 13/14; H01H 13/83; H01H 13/52; H01H 13/20; H01H 2013/525; E05B 13/002; E05B 65/52; E05B 47/0012

USPC ..... 200/43.01, 43.11, 43.13, 43.16, 43.18

See application file for complete search history.

(56) References Cited

U.S. PATENT DOCUMENTS 5,045,648 A * 9/1991 Fogleman, Sr. ..... H01H 3/20 200/325

* cited by examiner

*Primary Examiner* — Edwin A. Leon
*Assistant Examiner* — Lheiren Mae A Caroc
(74) *Attorney, Agent, or Firm* — Wang Law Firm, Inc.

(57) ABSTRACT

A button locking device includes a panel, a button installed on the panel, a bottom plate installed under the button, a first cylinder spring installed between the button and the bottom plate for resetting the button, an actuator assembly installed between the panel and the bottom plate, a toggle member installed under the button and pushed by the actuator assembly to rotate from a first position to a second position and rotated from the second position to the first position. At the first position, the toggle member stops the button from moving downward. At the second position, the toggle member allows the button to move downward. The present invention has the features of simple structure, convenient operation, low power consumption, high safety, and broad scope of applicability.

17 Claims, 10 Drawing Sheets

BUTTON LOCKING DEVICE

FIELD OF INVENTION

The present invention relates to a suitcase lock, in particular to a button locking device.

BACKGROUND OF INVENTION

1. Description of the Related Art

Hard suitcases generally adopt a mechanical key to open a lock of the suitcase or adopt a combination lock. In the suitcases adopting the mechanical key to open the lock, the locking device, lock and key of the suitcases of this sort come with a simple structure, so that the lock can be opened by a similar key or tool. In the suitcases adopting the combination lock, the number of combinations is relatively small, and the unlock operation is relatively complicated.

In addition, some suitcases may adopt an electronic combination lock, such as a fingerprint lock for suitcases as disclosed in P.R.C. Pat. No. 200720105408.0, and the fingerprint lock comprises a left lock and a right lock, and each of the left and right locks has a lock housing, a hook, a pressing plate and a hook iron plate. The fingerprint lock further comprises a locking block, an unlock button, an elastic plate, a fingerprint collector, a motor, a shifting block, a shifting post, a lock lever and an electronic control component. For an unlock, the motor is rotated to move the shifting block for a distance in the direction towards the middle of the lock, and the shifting post push the lock lever to move in the direction towards the middle of the lock, so that a bump formed at the front end of the lock lever enters into a cavity of the unlock button. Now, the unlock button may be pressed to enter into the locking block, and two pins of the unlock button are extended from a crevice at the bottom of the locking block, and the rear end of the hook iron plate and both ends of the elastic plate are pushed to compress both ends of the elastic plate, so that the rear end of the hook iron plate is detached from the protrusion of the locking block, and the spring is provided for pushing the pressing plate to pop out in order to drive the hook iron plate and the hook to move towards both ends of the lock respectively, so as to open the portable suitcase.

In the aforementioned technical solution, the button is unlocked by the rotation of the motor, so that the shifting block and the shifting post are driven to move the bump at the front end of the lock lever into the cavity of the button. Now, the button can be pressed. On the other hand, the button is locked by the rotation of the motor in a reverse direction, so that the shifting block and the shifting post are driven to move the bump at the front end of the lock lever out of the cavity of the button, and the button cannot be pressed to open the portable suitcase.

In the aforementioned patented technologies, there are relatively more motor driving components as well as a heavier load, so that it requires a power supply (generally a dry cell) to supply a larger power, and it is necessary to change the battery more frequently, and the scope of applicability of the locks of this sort will be affected adversely.

2. Summary of the Invention

Therefore, it is a primary objective of the present invention to provide a suitcase button locking device with the features of simple structure, convenient operation, and low power consumption.

To achieve the aforementioned and other objective, the present invention discloses a suitcase button locking device, comprising: a panel, having a button installed thereon, a bottom plate installed under the button, and a first cylinder spring installed between the button and the bottom plate for resetting the button, characterized in that the button locking device further comprises an actuator assembly installed between the panel and the bottom plate, a toggle member installed under the button, and driven by the actuator assembly to rotate from a first position to a second position and rotate from the second position to a first position, and the toggle member situated at the first position blocks the button to move downward, and the toggle member situated at the second position allows the button to move downward.

Wherein, the toggle member comprises: a dial lever, a bolt hub installed onto the dial lever, an arm extended from the bolt hub, a first tooth disposed on the bolt hub, and a first groove disposed adjacent to the first tooth, a pivot installed to the bolt hub, a first shaft hole formed on the panel, and a second shaft hole formed on the bottom plate, and a first sliding groove formed at the arm.

The actuator assembly comprises: a motor, a drive shaft installed onto a shaft of the motor, a free end and the drive shaft fixed and coupled to the second cylinder spring, a follower shaft axially displaceable in the second cylinder spring, a pin disposed on the follower shaft rotatable into the second cylinder spring, and an end extended out from the outer periphery of the second spring being installed into the first sliding groove.

The button comprises a first protrusion capable of entering into the first groove, and when the toggle member is situated at the first position, the first tooth is opposite to the first protrusion, and when the toggle member is situated at the second position, the first groove is opposite to the first bump.

Wherein, the first tooth is consisted of three partially ring members disposed on the outer periphery of the bolt hub, and the first groove is consisted of three openings formed between the three partially ring members, and the first protrusion is consisted of three partially ring stepped platforms disposed on an inner plane of the button and distributed in the same circle.

Wherein, one of the three partially ring members proximate to an arm has an arc length greater than the arc length of the remaining two partially ring members, and the opening of the partially ring member has an arc greater than the arc length of the remaining two openings.

The button locking device further comprises two first positioning posts symmetrically installed on the inner plane of the button, a second positioning post installed on the bottom plate and configured to be corresponsive to the first positioning post, and the first spring being installed between the first positioning post and the second positioning post.

Wherein, the first positioning post and second positioning post are cross-shaped vertical ribs, and an end surface of cross-shaped vertical rib is matched with the circular arc surface of the inner periphery of the first spring.

The button locking device further comprises a pair of guide posts symmetrically installed on the inner plane of the button, a boss disposed on the outer surface of the bottom plate, a pair of guide holes formed on the boss, an actuation plate for actuating the bottom of the panel device, and the guide post is passed through the guide hole and then fixed with the actuation plate.

Wherein the panel includes a second plane, a second vertical surface, and a first circular arc surface coupled to the first plane, and a first opening being formed at the middle of the second circular arc surface for installing the button, and a first frame being extended downwardly from the first opening and slidably matched with the external contour of the button; the button includes a first plane matched with a second plane, a first circular arc surface matched with a second circular arc surface, and a first vertical surface parallel to the second vertical surface and inwardly retracted, and the first vertical surface has an outer surface slidably matched relation with the inner surface of the second vertical surface inner surface.

The button locking device further comprises: a second frame installed on the bottom plate and disposed opposite to the first frame position, a support base disposed at the lower edge of the first frame, a spherical protrusion disposed at the top of the support base, and a second spherical recession disposed on the inner plane of the button and matched with the spherical protrusion.

Preferably, the pivot includes a first spherical end surface and a second spherical end surface, and the first shaft hole is a first spherical recession formed at the bottom of the support base and matched with the first spherical end surface, and the second shaft hole is a second blind hole formed in the second frame and capable of accommodating the second spherical end surface, and the blind hole has a pin installed therein and a third cylinder spring sheathed on the pin, and a head of the pin abuts against the second spherical end surface, and the third cylinder spring applies an axial bias force to the pin.

Preferably, the first shaft hole is a first blind hole formed at the bottom of the support base and slidably matched with an end of the pivot, and the second shaft hole is a second blind hole formed in the second frame and slidably matched with the other end of the pivot, and a disc elastic gasket is further included and installed between the bolt hub and the second blind hole.

The button locking device further comprises a third frame vertically installed in the second plane of the panel, a fourth frame installed on the bottom plate and capable of latching with the third frame, a concave stop opening formed on the third frame, and a convex stop opening formed on the fourth frame and matched with the concave stop opening.

The button locking device further comprises a first positioning frame installed in the third frame of the panel and provided for fixing a motor of the actuator assembly, and a second positioning frame installed on the bottom plate and matched with the first positioning frame.

The button locking device further comprises a pair of elliptical cylinders installed at an end of the follower shaft and perpendicular to the follower shaft, and an upper slide rail and a lower slide rail installed on the panel and the bottom plate respectively and slidably matched with the elliptical cylinder.

The button locking device further comprises: a circuit board installed between the panel and the bottom plate, a set numeric key, a first light signal indicator and a second light signal indicator installed on the circuit board, a set of key holes formed on the first plane of the panel and capable of installing the set numeric key, a first window formed at the top of the key holes and capable of exposing the first light signal indicator, and a second window formed at the top of the first opening and capable of exposing the second light signal indicator.

Wherein, the key holes are consisted of 4~6 round holes arranged side by side with each other, and the round hole includes an axially protruding round table, and the set numeric key includes key caps slidably matched with the round hole and the round table.

Wherein, the first light signal indicator includes a first group of LED lamps installed at a first flange of the circuit board and a first light guide member for accommodating the first group of LED lamps, and the second light signal indicator includes a second groups of LED lamps installed at a second flange of the circuit board and a second light guide member for accommodating the second group of LED lamps.

Wherein, the first window is in a strip rectangular shape, and the second window is in a V-shape, and the first flange and the second flange are symmetrical protruding areas at the middle of the circuit board, and the first light guide member includes a first groove for accommodating the first flange and the first group of LED lamps, and a strip protrusion embeddable into the first window, and the second light guide member includes a second groove for accommodating the second flange and the second group of LED lamps and a V-shaped protrusion embeddable into the second window, and each of the first group of LED lamps and the second group of LED lamps includes a red LED lamp, a green LED lamp, and a yellow LED lamp.

The button locking device of the present invention has the following advantages and effects:

1. The invention adopts the structure with the dial lever installed under the button, and the actuator assembly is controlled to push the dial lever to switch the positions for blocking the button and releasing the blocking of the button in order to lock and unlock the button. With the principle of lever, the force used for pushing the dial lever is very small, so that the invention can save power significantly.

2. The invention adopts a pivot with a spherical shaft head and two blind shaft holes in correspondence with the pivot to achieve the effect of a thrust bearing, so as to reduce the friction produced during the process of rotating the dial lever.

3. Both button and panel are structures with an L-shaped cross-section, so that the shape of the button is matched with the shape of the panel to facilitate the operation and save the space occupied by the button and panel.

4. The structure with the light guide member embedded into the panel is used to replace the conventional LED signal light, and such arrangement not only saves the wiring only, but also makes the signal indication more eye-catching and softer since the light emitting area is large.

5. The panel device has the features of small volume, simple compact structure, convenient operation, high safety, and broad scope of applicability.

DESCRIPTION OF THE PREFERRED EMBODIMENTS

The above and other objects, features and advantages of this disclosure will become apparent from the following detailed description taken with the accompanying drawings.

Figure 1:
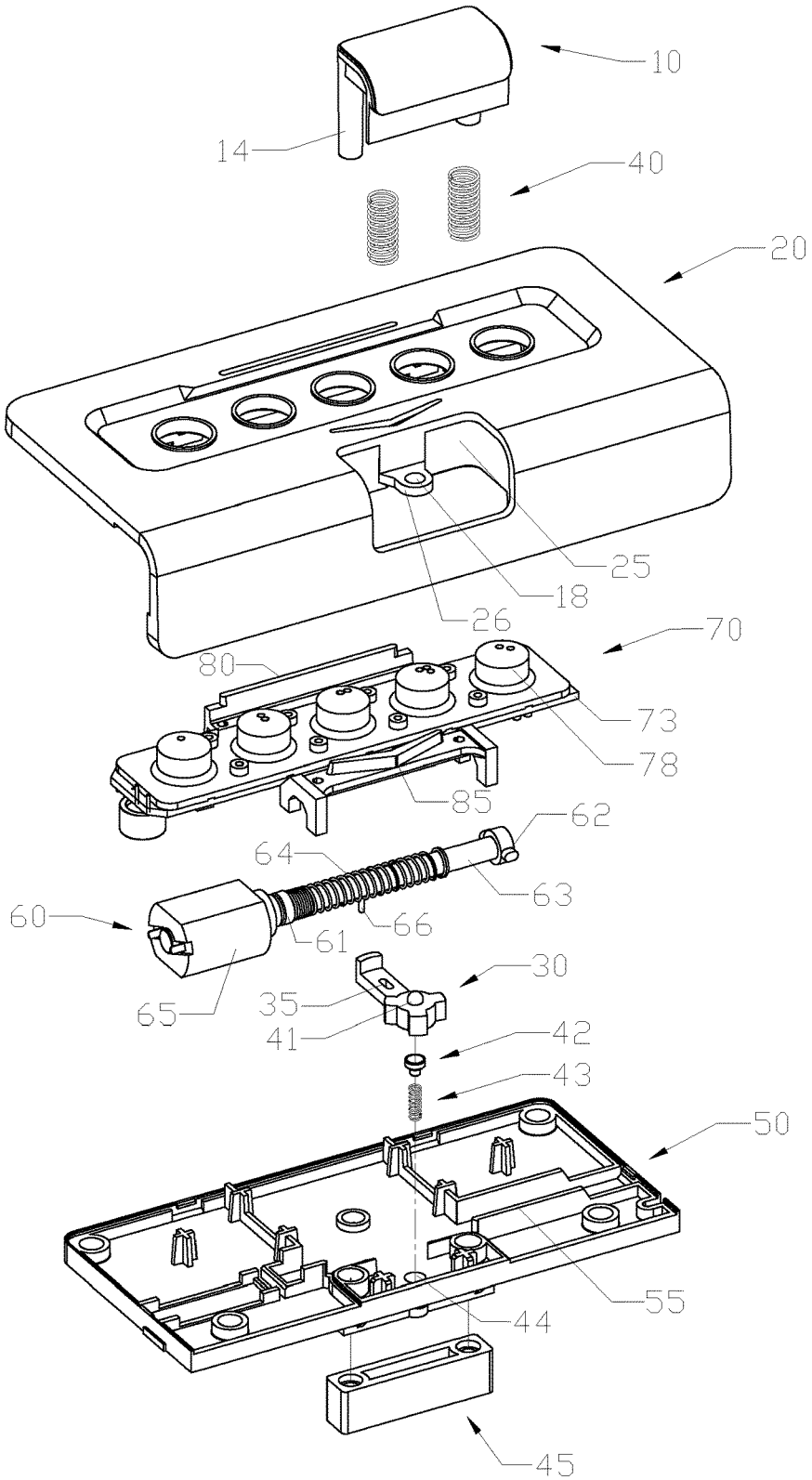
FIG. 1 is an exploded view of a preferred embodiment of the present invention.

With reference to FIG. 1 for the structure of a button locking device in accordance with a preferred embodiment of the present invention, the button locking device is used in an electronic locking device of a hard portable suitcase. Unlike the conventional suitcase locking device installed on a vertical surface of a suitcase body, the panel device of this preferred embodiment is installed to the top of a suitcase cover. After a button 10 is unlocked, a suitcase lock mechanism installed on the suitcase body is actuated. From a side view, both button 10 and panel 20 are L-shaped, and after such structures are installed to the suitcase cover, user can operate the button 10 to lock and unlock the suitcase more conveniently.

In FIG. 1, the button 10 is installed into a first opening 25 of the panel 20. After the button 10 is installed into the first opening 25, the first opening 25 will be covered precisely, and a restoring spring 40 (which is a first cylinder spring) is installed between the button 10 and a bottom plate, so that after the external force applied to the button 10 is released, the spring 40 is reset to resume the button 10 to its original position. The circuit board 70 has a control unit and a set numeric key 78 installed thereon and a first light guide member 80 and a second light guide member 85. An actuator assembly 60 is installed at the top of the dial lever 30. After a bottom plate 50 and the panel 20 are assembled to form a closed box, the aforementioned components are protected.

Figure 2:
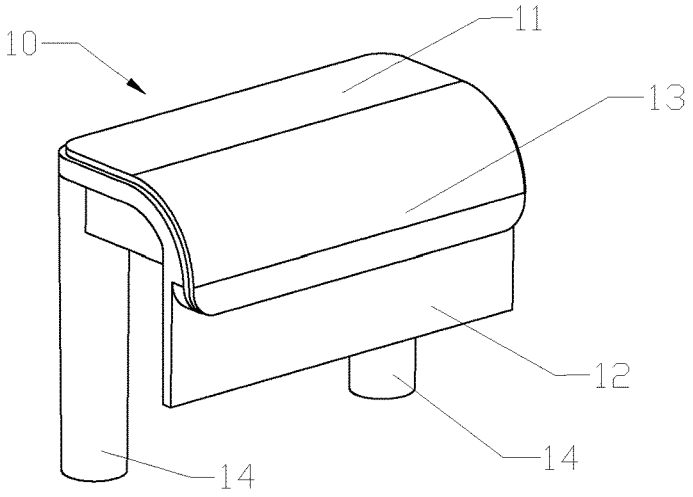
FIG. 2 is a perspective view of a button of a preferred embodiment of the present invention.
Figure 3:
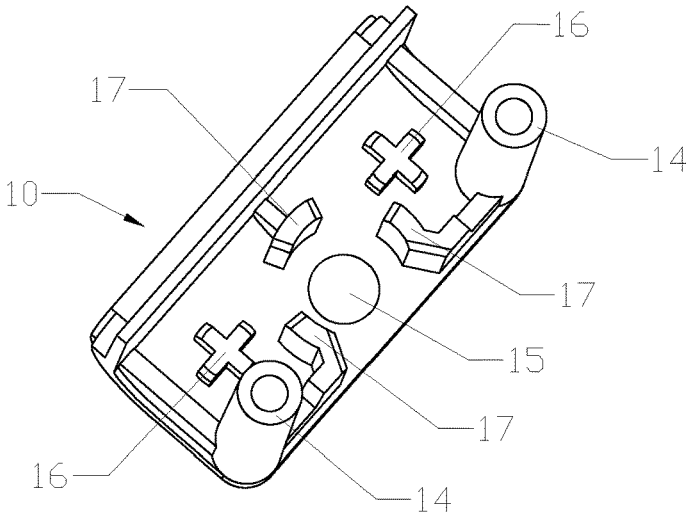
FIG. 3 is another perspective view of a button of a preferred embodiment of the present invention.

With reference to FIGS. 2 and 3 for the structure of the button 10, the button 10 is substantially in the shape of a rectangular half casing, and the outer surface of the button 10 includes a first plane 11 and a first vertical surface 12 perpendicular to each other, and a first circular arc surface 13 coupled to the first plane 11, and the first plane 11 is exactly the plane provided for being pressed by a finger, and the first vertical surface 12 opposite to the second vertical surface 22 of the panel 20 is withdrawn inwardly, and after the button 10 is installed into the first opening 25 of the panel 20, the first vertical surface 12 and the second vertical surface 22 in the first opening 25 have a slidably corresponding relation. The inner surface of the first plane 11 has three first protrusions 17, and one of the first protrusions is proximate to the first vertical surface 12, and the other two are proximate to the inner end of the button 10, and such two first protrusions 17 are symmetrically arranged into 180 degrees with respect to each other, so that the three first protrusions 17 are arranged in the shape of a partially ring member and distributed in the same circle, and the three first protrusions 17 has a height substantially equal to the stroke of the button 10. Both sides of the first protrusion 17 have a first positioning post 16 for limiting the restoring spring 40, and a position of the first protrusion 17 corresponding to the bottom plate 50 has a second positioning post 56 identical to the first positioning post 16, and the first positioning post and second positioning post are cross-shaped vertical ribs, and an end surface of the cross-shaped vertical rib is a circular arc surface matched with the inner periphery of the first spring. After the button 10, the panel 20, and the bottom plate 50 are assembled, the restoring spring 40 is limited by the first positioning post 16 and the second positioning post 56. The button 10 further has a pair of guide posts 14 for connecting the actuation plate 45, and the guide posts 14 are installed at two corners of the rear end of the button 10 respectively. Since the guide posts are relatively long, they are fixed to the actuation plate 45 after extending out from the guide holes 58 of the bottom plate 50. The middle of the three first protrusions 17 has a second spherical recession 15 matched with first spherical protrusion 18 disposed on the top of the support base 26. In FIG. 1, the support base 26 is disposed at the bottom edge of the first opening 25. After the button is pressed and the second spherical recession 15 is in contact with the spherical protrusion 18, the button 10 provides both guiding and positioning effects.

Figure 4:
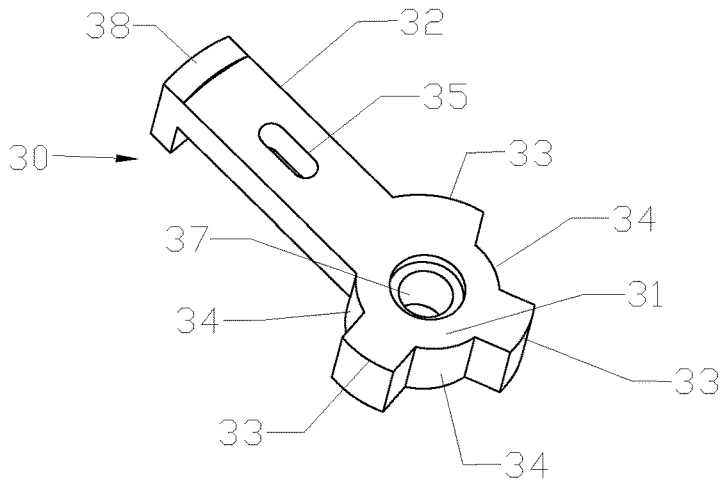
FIG. 4 is a perspective view of a dial lever of a preferred embodiment of the present invention.
Figure 5:
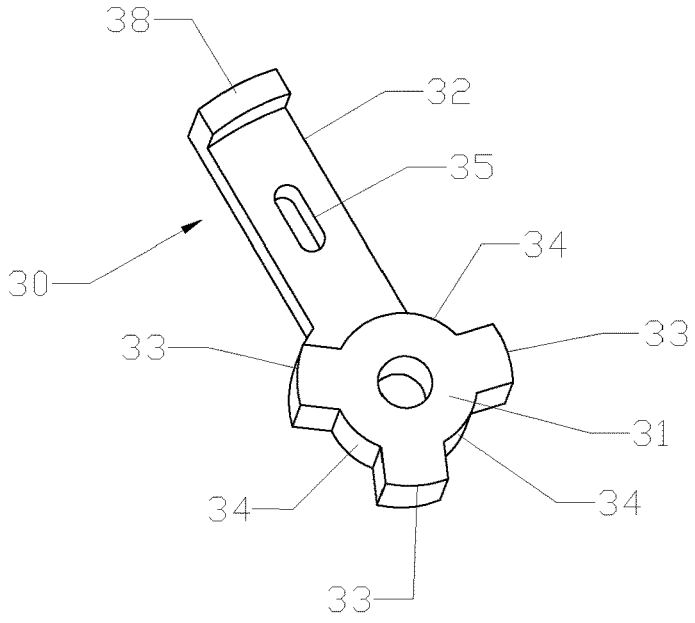
FIG. 5 is another perspective view of a dial lever of a preferred embodiment of the present invention.

With reference to FIGS. 4 and 5 for the structure of the dial lever 30, the dial lever 30 comprises a bolt hub 31, an arm 32, a pivot hole 37 formed on the bolt hub 31, and the arm 32 is disposed across a coil spring 64 of the actuator assembly 60, and a first sliding groove 35 is formed on a side facing the actuator assembly 60, and the first sliding groove 35 has semicircular rectangular grooves formed on both sides. After a head of a pin 66 is installed into the first sliding groove 35, the pin 66 may slide in the groove. When the pin 66 is displaced in an axial direction, the portion of the pin 66 installed into the sliding groove will produce a friction with respect to the wall of the sliding groove to produce an action force to push the dial lever 30 to rotate. Three first teeth 33 are protruded outwardly from the outer periphery of the bolt hub 31, and they are the three partially ring members, and the protrusion proximate to the arm 31 is larger than the other two protrusions, and the circle formed by the distribution of the three partially ring members has a diameter equal to the diameter of the circle formed by the distribution of the three first protrusions 17 of the button 10. The first groove 34 is consisted of three openings among the three partially ring members. When the arm 32 is situated at the first position (which is the locked position), the three first teeth 33 are precisely opposite to the three first protrusions 17 of the button respectively, and the stroke of the button 10 is blocked by the three first teeth 33, so that the button 10 cannot be pressed down. When the arm 31 is situated at the second position (which is the unlocked position), the first tooth 33 is rotated for an angle, so that the first groove 34 is aligned precisely with the first protrusion 17, so that when the button 10 is pressed, the first protrusion 17 enters into the first groove 34, and the stroke of the button 10 is not blocked, and the button 10 is released from locking.

Figure 8:
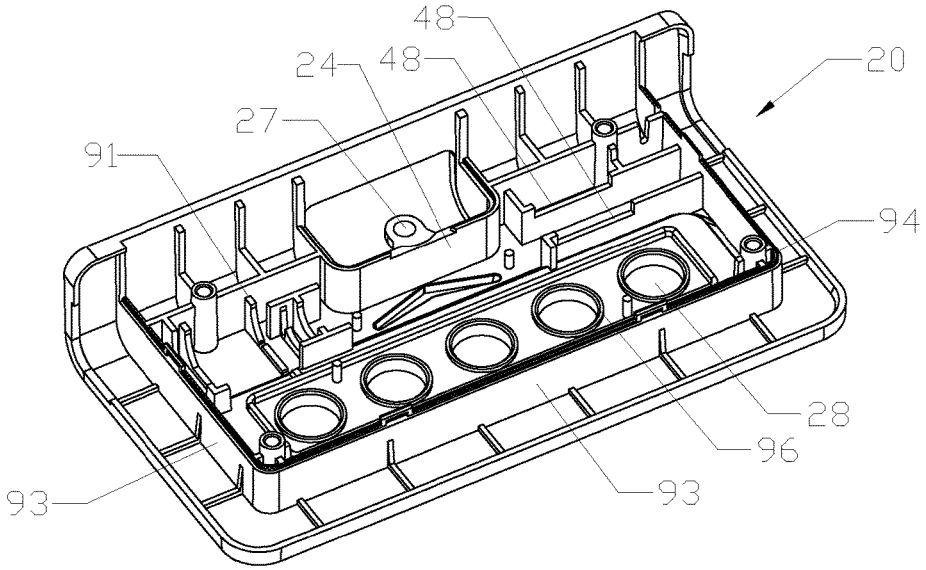
FIG. 8 is another perspective view of a panel of a preferred embodiment of the present invention.
Figure 9:
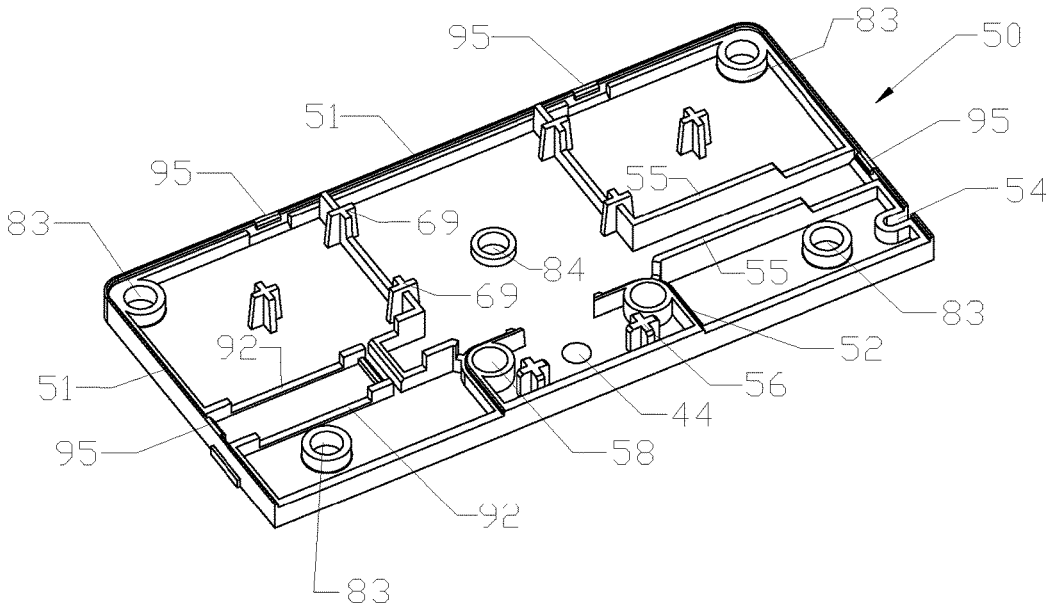
FIG. 9 is a perspective view of a bottom plate of a preferred embodiment of the present invention.

In FIGS. 1, 8, and 9, the pivot includes a first spherical end surface and a second spherical end surface, and the pivot 41 matched with the pivot hole 37 of the dial lever 30 has two identical spherical ends, and the pivot hole 37 and the pivot 41 are fixed by interference fit. The bottom of the support base 26 has a first shaft hole 27, and the first shaft hole is a first-side spherical recession matched with a spherical end of the pivot 41. A second shaft hole 44 is formed at a position of the bottom plate 50 corresponsive to the first shaft hole 27, and the second shaft hole is a second blind hole, and the second blind hole has a pin 42 and a third cylinder spring 43 installed therein. After the other spherical end of the pivot 41 is installed into the second blind hole, a head of the pin 42 elastically abuts against the spherical end of the pivot 41, so that after the dial lever 30 is assembled, an axial preset elastic force is exerted. As to the pivot 41, the pin 42 is equivalent to a propping pin, so that a gap is maintained between the bolt hub 31 and a plane of the second blind hole, and such structure prevents the bolt hub 31 from touching the bottom plate 50 during the process of rotating the dial lever 30, so as to minimize the friction. When the button 10 situated at the locked state is pressed, the first protrusion 17 and the first tooth 33 are contacted with each other, and the downwardly pressing force moves the bolt hub 31 downward, and the pin 42 is pressed into the second blind hole, and the bolt hub 31 is in contact with the plane of the bottom plate 50. When the button 10 released from its locked state is pressed, the first protrusion 17 enters into the first groove 34, while the second spherical recession 15 of the button 10 is pressed onto the first spherical protrusion 18 of the support base 26. Since the panel 20 is a plastic member, and the support base 26 has a specific elasticity, the downward pressure bends the support base 26 downward, so that the pivot 41 is moved downwardly. After the pin 42 and the third cylinder spring 43 are pressed into the second blind hole, the plane of the bolt hub 31 is in contact with the plane of the bottom plate 50. When the aforementioned two types of buttons are pressed, a larger contact area can be maintained and provided for bearing the pressing force of the button 10.

As to the way of reducing the friction during the process of rotating the dial lever 30, there is another technical solution as described below. The first shaft hole 27 is a first blind hole, and the second shaft hole 44 is a second blind hole, and the second blind hole does not have the pin 42 and the third cylinder spring 43, and the second blind hole can be shallower as long as it can accommodate the spherical end of the pivot 41. An elastic disc gasket (not shown in the figure) is installed between the bolt hub 31 and the second blind hole and sheathed on the pivot 41, and the opening of the disc gasket is in contact with a plane of the bottom plate 50, and the disc bottom is in contact with the bolt hub 31. After the dial lever 30 is assembled with the panel 20 and the bottom plate 50 and if the button 10 is not pressed, a gap with the height of the disc gasket is maintained between the bolt hub 31 and the bottom plate 50. During the process of rotating the dial lever 30, the bolt hub 31 is just in contact with the disc bottom (which is smaller than the disc gasket) only, but not in contact with the plane of the bottom plate 50, and such arrangement also can reduce the friction effectively. After the button 10 is pressed, the disc gasket is pressed and flattened to increase the contact area of the bolt hub 31, in order to bear the larger pressure from the button.

Figure 6:
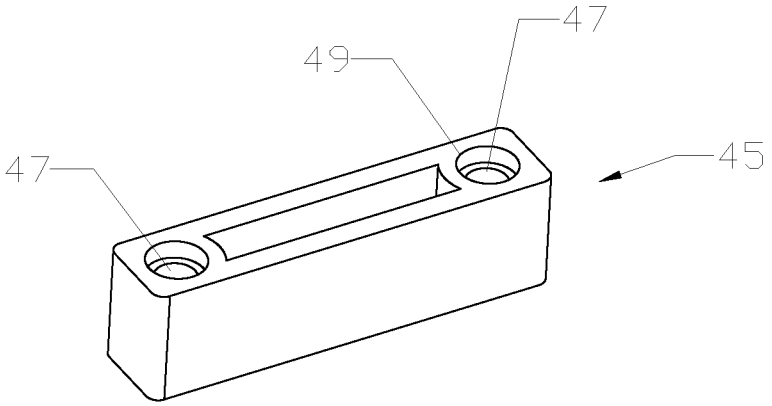
FIG. 6 is a perspective view of an actuation plate of a preferred embodiment of the present invention.
Figure 10:
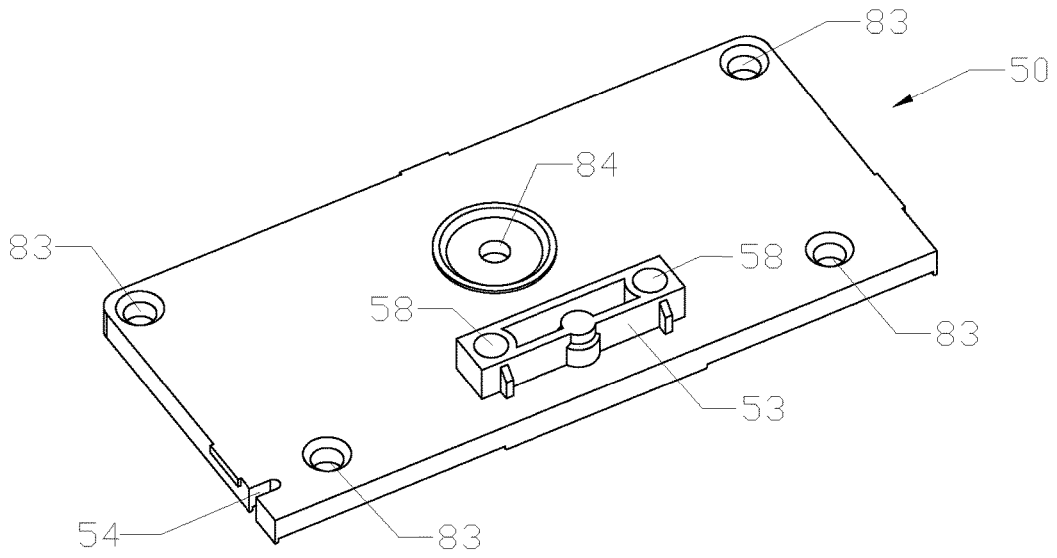
FIG. 10 is another perspective view of a bottom plate of a preferred embodiment of the present invention.

With reference to FIG. 6 for the structure of the actuation plate 45 as well as FIGS. 1 and 10, the actuation block 45 is a rectangular body, and the actuation block 45 has a pair of through holes 47 coaxially configured with the guide post 14, and the through hole 47 has a sunken hole 49. After the guide post 14 is passed through the guide hole 58, the head of the guide post 14 enters into the sunken hole, and then a pair of screws are passed through the through hole 47. When the screws are installed into the screw holes formed at the end of the guide post 14, the actuation block 45 is fixed to the rear end of the guide post 14. The actuation block 45 is designed with a shape according to the suitcase lock mechanism of the suitcase body. When the button 10 is pressed, the actuation block 45 is moved downward accordingly and contacted with another mechanical button of the suitcase lock mechanism to actuate the mechanical button to release the locking of the suitcase lock.

Figure 7:
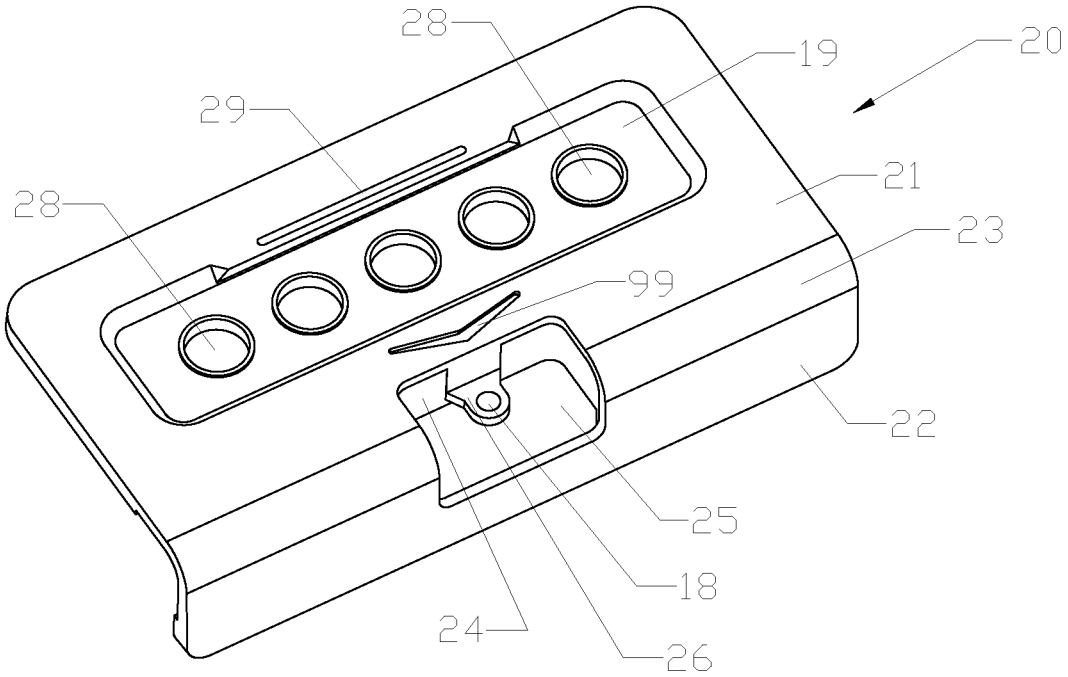
FIG. 7 is a perspective view of a panel of a preferred embodiment of the present invention.

With reference to FIGS. 7 and 8 for the structure of the panel 20, the panel 20 is substantially in a shape similar to an L-shape formed by bending a rectangular flat plate for 90 degrees to have two mutually perpendicular planes, and the bent position is the partially cylindrical surface. The horizontal surface as shown in FIG. 7 is the second plane 21, and the vertical surface is the second vertical surface 22, and the bent position is a second circular arc surface 23. The first opening 25 having the button 10 installed therein is installed at the middle position of the second circular arc surface 23. Obviously, the first opening 25 also occupies a portion of the second plane 21 and the second vertical surface 22. After the button 10 is installed into the first opening 25, the first opening 25 is filled up. In other words, the two planes of the button 10 are the first plane 11 and the first vertical surface 12 matched with the second plane 21 and the second vertical surface 22 of the panel 20, and the first circular arc surface 13 of the button 10 is matched with the second circular arc surface 23 of the panel. Besides the second vertical surface 22, a first frame 24 with the guiding effect is extended downwardly from the other three edges of the first opening 25, and the support base 26 is disposed at the middle of the lower edge of the first frame 24, and the other three vertical surfaces of the button 10 is slidably matched with the first frame 24, and the outer surface of the first vertical surface 12 of the button 10 is slidably matched with the inner surface of the second vertical surface 22 of the panel 20. A sunken plane 19 is disposed at the middle of the second plane 21 of the panel 10, and five key holes 28 are arranged side by side with each other on the plane and matched with the key caps of the numeric keys respectively. A strip window 29 is formed at the intersection of the top of the key holes 28 and the sunken plane 19 and matched with the first light guide member 80, and a V-shaped window 99 is formed at the top of the first opening 25 and matched with the second light guide member 85.

In FIG. 8, a rectangular third frame 93 is vertically installed onto the inner surface of the second plane 21 inner surface, and four edges of the bottom plate 50 have a fourth frame 51 engaged with the third frame 93 (as shown in FIG. 9) by a concave stop opening 94 formed on the third frame 93, and a convex stop opening 95 formed on the fourth frame 51 and matched with the concave stop opening 94. After the bottom plate 50 and the panel 20 are assembled, a sealed box is formed. In FIG. 8, a round table 96 with a protrusion is formed around the key hole 28, and the round table 96 lengthens the key hole 28 in an axial direction, so as to provide the limiting and guiding effects to the key cap.

With reference to FIGS. 9 and 10 for the structure of the bottom plate 50, the bottom plate 50 also has a second frame 52 installed at a position opposite to the first frame 24 of the panel 20, in addition to the fourth frame 51 engaged with the third frame 93 of the panel 20. The second blind hole, the second positioning post 56 for positioning the restoring spring 40, and the guide hole 58 are disposed in the second frame 52, and a rectangular boss 53 is disposed on the backside of the second frame 52 (which is the outer surface of the bottom plate), and the guide hole 58 is passed through the boss. The bottom plate 50 has four through holes 83 for fixing the panel 20 and also has a hole 84 for exposing the button, and a wire outlet hole 54.

Figure 11:
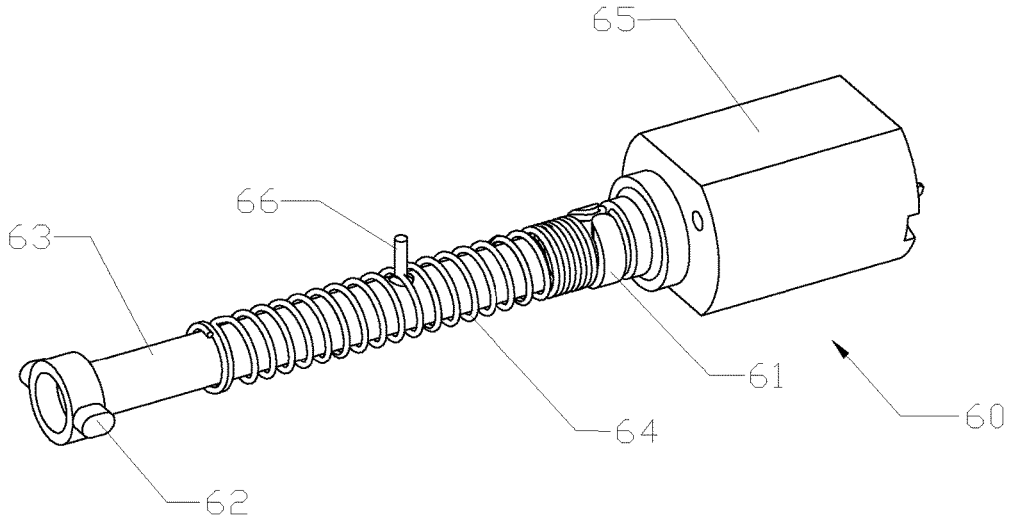
FIG. 11 is a perspective view of an actuator assembly of a preferred embodiment of the present invention.

With reference to FIG. 11 for the structure of the actuator assembly 60, the motor 65 is a direct current (DC) motor, and the coil spring 64 is a second cylinder spring, and its free end is fixed to the drive shaft 61, and a large portion of the follower shaft 63 is disposed a the inner periphery of the coil spring 64, and the pin 66 is installed at the middle of the follower shaft 63, and a head of the pin 66 is installed into the first sliding groove 35 of the dial lever 30.

With reference to FIGS. 8 and 9 for the way of fixing the actuator assembly 60, the third frame 93 of the panel 20 and the fourth frame 51 of the bottom plate 50 have a first positioning frame 91 and a second positioning frame 92 installed therein for fixing the motor 65. Wherein, the first positioning frame 91 of the panel 20 is a protrusion, and a pair of ribs disposed on an inner plane of the panel, and the pair of ribs are perpendicular to the axis of the motor 65, and a protrusion at an end rib forms a curved surface matched with the motor housing, and a circular arc recession is formed at the backside of the plane 18, configured to be opposite to the pair of curved surfaces, and matched with the motor housing. The second positioning frame 92 consists of two strip ribs parallel to the follower shaft 63, and the two strip ribs have a strip recession formed in an axial direction for accommodating the motor housing. After the motor 65, the panel 20, and the bottom plate 50 are assembled, the curved surface of the panel 20 and the circular arc recession are latched with the upper half of the motor housing, and the strip recession of the bottom plate 50 is latched to the lower half of the motor housing. After the panel 20 and the bottom plate 50 are installed and fixed by the screws, the actuator assembly 60 is installed and fixed properly.

With reference to FIG. 1 as well, the ends of the follower shaft 63 are designed as two elliptical cylinders 62 symmetrically protruded from the protrusion, and the pair of elliptical cylinders 62 are disposed on an upper slide rail 48 of the panel 20 and a lower slide rail 55 of the bottom plate 50 respectively, and the upper slide rail 48 is comprised of two recessions formed on two parallel rectangular strips, and the two elliptical cylinders 62 are disposed precisely in the two recessions, and the recession has a length exactly equal to the working stroke of the follower shaft 63. The lower slide rail 55 is consisted of two rectangular ribs corresponsive to the two recessions, and the rectangular rib is slightly longer than the recession and precisely covers the recession. After the panel 20 and the bottom plate 50 are assembled, the elliptical cylinder 62 is limited by the upper and lower slide rails and can only slide between the upper slide rail 48 and the lower slide rail 55.

Figure 12:
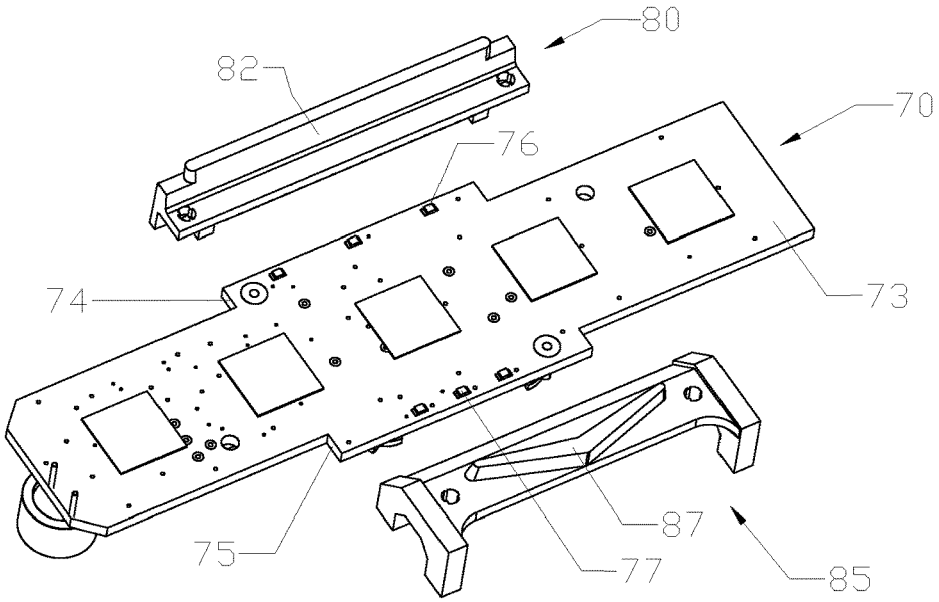
FIG. 12 is a perspective view of a circuit board installed with a first light guide member and a second light guide member in accordance with of a preferred embodiment of the present invention.
Figure 13:
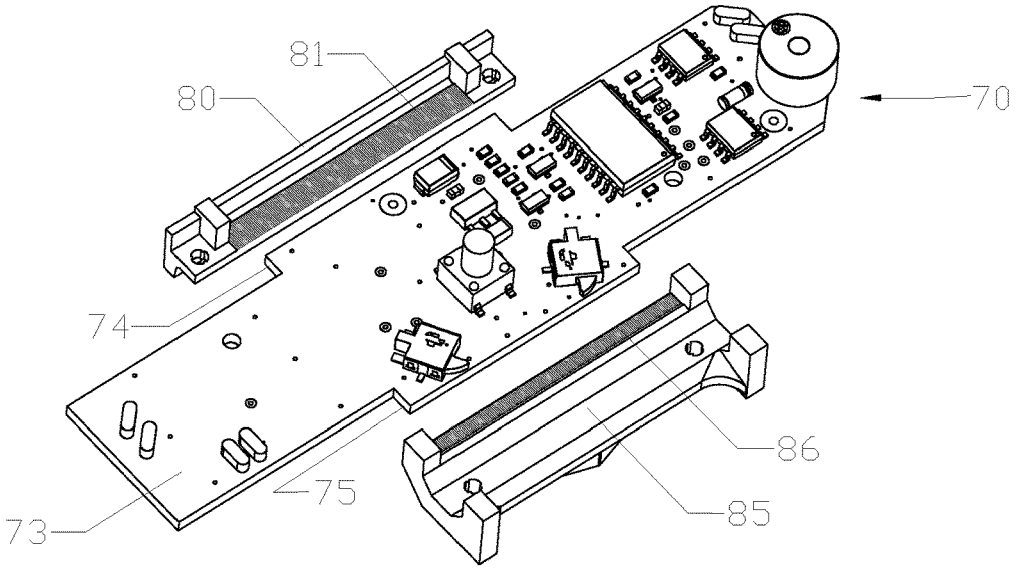
FIG. 13 is another perspective view of a circuit board installed with a first light guide member and a second light guide member in accordance with of a preferred embodiment of the present invention.
Figure 16:
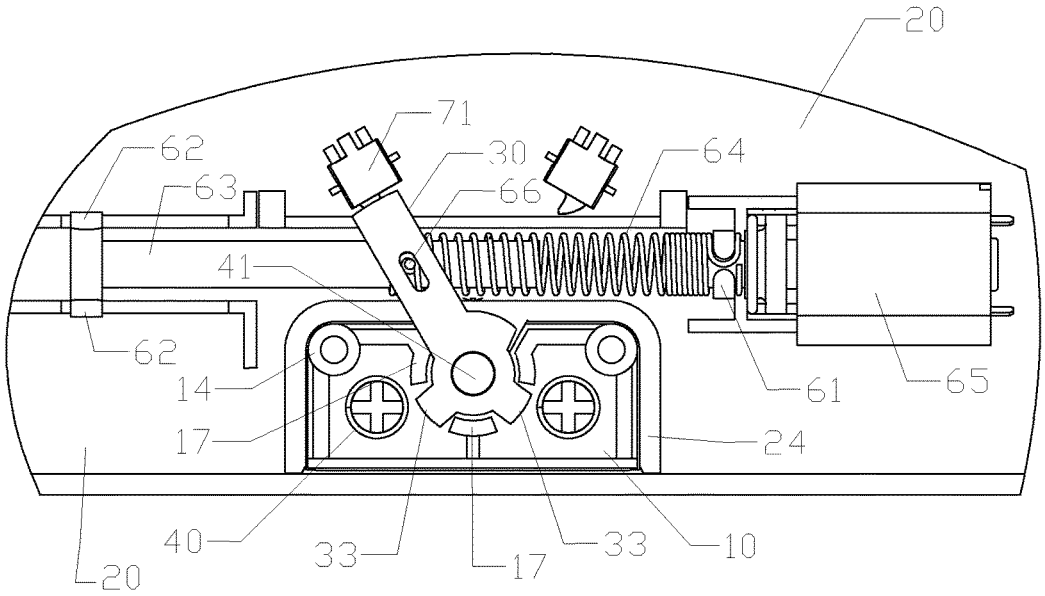
FIG. 16 is a schematic view of a dial lever situated at an unlocked position in accordance with a preferred embodiment of the present invention, after a button, a dial lever, and an actuation assembly are assembled with one another.

With reference to FIGS. 12, 13, and 16 for the structure of a circuit board 70 and a light guide member of the present invention, the circuit board 70 includes a double-sided printed circuit board 73, and a section is extended symmetrically from the middle of the circuit board 73 to form a first flange 74 and a second flange 75. In FIG. 13, the circuit board 73 has an integrated circuit installed on a surface facing the bottom plate 50 for controlling the actuator assembly 60, and the first position switch 71 and other electronic devices. In FIG. 12, the circuit board 73 has two SMD LED installed on a side facing the panel 20, and the first group of LED lamps 76 refers to three SMD LED uniformly distributed on the first flange 74, and a second group of LED lamps 77 (In other words, another three SMD LED are uniformly distributed on the second flange 75). In FIGS. 12 and 13, the two flanges of the circuit board are symmetrical, and the first groove 81 of the first light guide member 80 and the second groove 86 of the second light guide member 85 are half grooves with the same shape and size. After the first flange 74 and the second flange 75 together with their three SMD LED are installed into the first groove 81 and the second groove 86 respectively, the SMD LED are in contact with a surface of the light guide member. Two pairs of vertical ribs 69 are installed at the positions of the corresponding half grooves of the bottom plate 50. After the bottom plate 50 and the circuit board 70 are assembled, the top of the two pairs of vertical ribs 69 exactly abuts against the planes of the openings of the first groove 81 and the second groove 8, so as to provide a fixing effect to the two light guide members and the circuit board 73.

The strip protrusion 82 of the first light guide member 80 and the V-shaped protrusion 87 of the second light guide member 85 are perpendicular to the circuit board 73, and they have the shape and size exactly embedded into the first window and the second window of the panel 20, and the first window and the second window are strip window 29 and V-shaped window 99 respectively and a planar steps are disposed next to the two protrusions, and they are in contact with the edge plane of the two windows, so as to achieve the effect of fixing the light guide member. The first group of LED lamps 76 and the second group of LED lamps 77 are formed by three SMD LED capable of emitting different color lights which are red, yellow, and green in this preferred embodiment. When one of the LEDs emits light, the light guide member for accommodating the LED emit light emitted from the LED, so as to achieve the effect of showing different color lights on the signal indication panel and indicating different statuses of the locking device.

Figure 14:
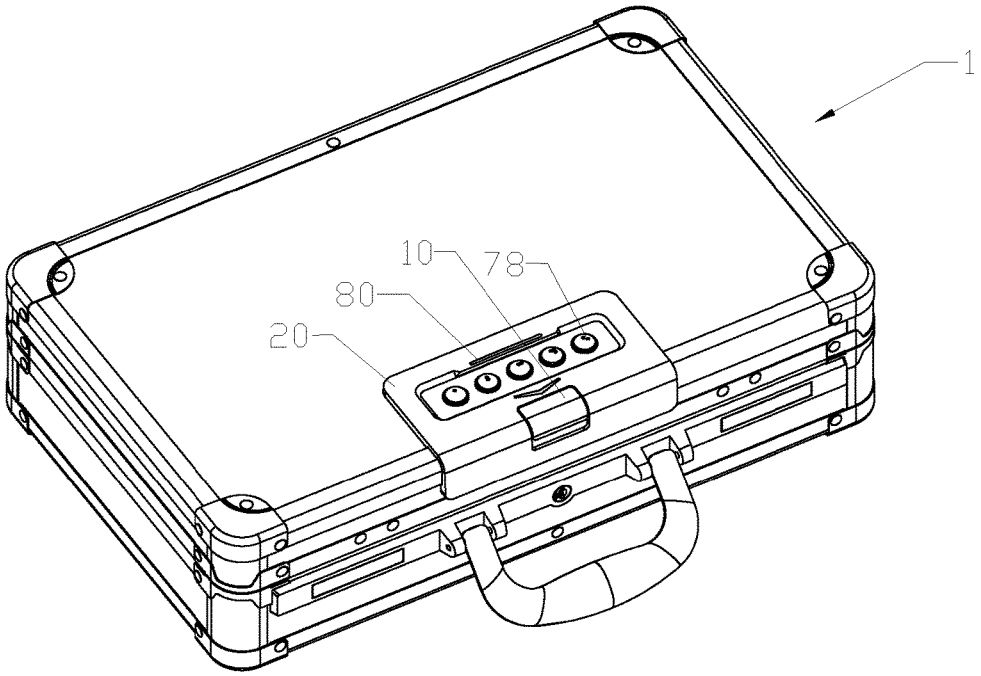
FIG. 14 is a perspective view of a button locking device installed to a suitcase body in accordance with of a preferred embodiment of the present invention.
Figure 15:
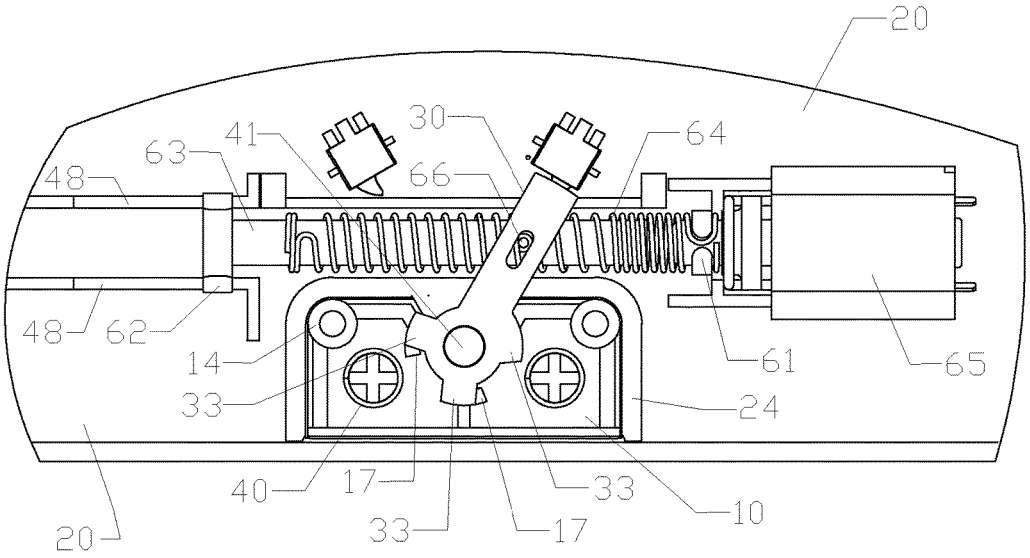
FIG. 15 is a schematic view of a dial lever situated at a locked position in accordance with a preferred embodiment of the present invention, after a button, a dial lever, and an actuation assembly are installed with one another.

In FIG. 14, the panel of the present invention may be installed onto the top of the suitcase cover of a portable suitcase 1 and used as an operation interface of the combination locking device of the portable suitcase. With reference to FIGS. 15 and 16 for the working process of the present invention, FIG. 15 shows that the dial lever 30 is situated at the first position, and the first tooth 33 and the first bump 17 of the button abut against each other. Now, the downward stroke of the button 10 is blocked by the first tooth 33 and the button 10 cannot be pressed down. In other words, when the button 10 is situated at the locked state, the portable suitcase cannot be opened. After a correct unlock password is entered through the set numeric key 78 of the panel 20, the motor 65 drives the coil spring 64 to start rotating, and the follower shaft 63 starts moving linearly, and the pin 66 is acted on the first sliding groove 35 of the dial lever 30 to drive the dial lever 30 to rotate from the first position to the second position as shown in FIG. 16. When the dial lever 30 is rotated to the second position, and an end of the arm 38 touches the head of the first position switch 71, the motor 65 is electrically disconnected and stopped. Now, the first groove 34 and the first protrusion 17 are aligned precisely. When the button 10 is pressed, the first protrusion 17 enters into the first groove 34. Since the downward stroke of the button 10 is not blocked, pressing the button 10 actuates the mechanical button installed on the suitcase body to unlock the suitcase lock mechanism. After the external force exerted onto the button 10 is released, the spring 40 resets the button 10. After the locking signal transmitted by the control unit is received, the motor 10 is rotated in a reverse direction, and the pin 66 pushes the dial lever 30 back to its locked position to resume the blocking of the button 10.

While the invention has been described by means of specific embodiments, numerous modifications and variations could be made thereto by those skilled in the art without departing from the scope and spirit of the invention set forth in the claims.

What is claimed is:

1. A button locking device, comprising:

a panel, having a button installed thereon, two first positioning posts symmetrically installed on an inner plane of the button, a bottom plate installed under the button, a plurality of first cylinder springs installed between the button and the bottom plate for resetting the button, two second positioning posts installed on the bottom plate and configured to correspond to the two first positioning posts, and each of the plurality of first cylinder springs being installed between each of the first positioning posts and the second positioning posts, characterized in that the button locking device further comprises an actuator assembly installed between the panel and the bottom plate, a toggle member installed under the button, and driven by the actuator assembly to rotate from a first position to a second position and rotate from the second position to the first position, and the toggle member situated at the first position blocks the button from moving downward, and the toggle member situated at the second position allows the button to move downward.

2. The button locking device of claim 1, wherein the toggle member comprises:

a dial lever, a bolt hub installed onto the dial lever, an arm extended from the bolt hub, a first tooth disposed on the bolt hub, and a first groove disposed adjacent to the first tooth, a pivot installed to the bolt hub, a first shaft hole formed on the panel, a second shaft hole formed on the bottom plate, and a first sliding groove formed at the arm;

the actuator assembly comprises: a motor, a drive shaft installed onto a follower shaft of the motor, a free end of the drive shaft fixed and coupled to a second cylinder spring, the follower shaft axially displaceable in the second cylinder spring, a pin disposed on the follower shaft rotatable into the second cylinder spring, and an end extended out from the second spring being installed into the first sliding groove; and the button comprises a first protrusion capable of entering into the first groove, and when the toggle member is situated at the first position, the first tooth is opposite to the first protrusion, and when the toggle member is situated at the second position, the first groove is opposite to the first protrusion.

3. The button locking device of claim 2, wherein the first tooth is consisted of three partially ring members disposed on an outer periphery of the bolt hub, and the first groove is consisted of three openings formed between the three partially ring members, and the first protrusion is consisted of three partially ring stepped platforms disposed on an inner plane of the button and distributed in a circular arc.

4. The button locking device of claim 3, wherein one of the three partially ring members proximate to an arm has an arc length greater than individual arc lengths of the remaining two partially ring members, and an opening of the one of the three partially ring members has an arc greater than individual arc lengths of openings of the remaining two partially ring members.

5. The button locking device of claim 2, further comprising a pair of guide posts symmetrically installed on the inner plane of the button, a boss disposed on an outer surface of the bottom plate, a pair of guide holes formed on the boss, an actuation plate under the bottom plate, and the guide post is passed through the guide hole and then fixed with the actuation plate.

6. The button locking device of claim 2 wherein the button further comprises:

a first plane, a first circular arc surface, and a first vertical surface; and the panel further comprises:

a second plane matched to the first plane of the button, a second vertical surface parallel to the first vertical surface, a first circular arc surface coupled to the first plane, and a first opening being formed at a middle of a second circular arc surface for installing the button, and a first frame being extended downwardly from the first opening and slidably matched with an external contour of the button;

wherein the first vertical surface retracts inwardly and has an outer surface slidably matched to an inner surface of the second vertical surface.

7. The button locking device of claim 6, further comprising a second frame installed on the bottom plate and disposed opposite to the first frame, a support base having a top and a bottom, the support base disposed at a lower edge of the first frame, a spherical protrusion disposed at the top of the support base, and a second spherical recession disposed on the inner plane of the button and matched with the spherical protrusion.

8. The button locking device of claim 7, wherein the pivot includes a first spherical end surface and a second spherical end surface, and the first shaft hole is a first spherical recession formed at the bottom of the support base and matched with the first spherical end surface, and the second shaft hole is a second blind hole formed in the second frame and capable of accommodating the second spherical end surface, and the blind hole has a pin installed therein and a third cylinder spring sheathed on the pin, and a head of the pin abuts against the second spherical end surface, and the third cylinder spring applies an axial bias force to the pin.

9. The button locking device of claim 7, wherein the first shaft hole is a first blind hole formed at the bottom of the support base and slidably matched with a first end of the pivot, and the second shaft hole is a second blind hole formed in the second frame and slidably matched with a second end of the pivot, and a disc elastic gasket is further included and installed between the bolt hub and the second blind hole.

10. The button locking device of claim 6, further comprising a third frame vertically installed in the second plane of the panel, a fourth frame installed on the bottom plate and capable of latching with the third frame, a concave stop opening formed on the third frame, and a convex stop opening formed on the fourth frame and matched with the concave stop opening.

11. The button locking device of claim 10, further comprising a first positioning frame installed in the third frame of the panel and provided for fixing a motor of the actuator assembly, and a second positioning frame installed on the bottom plate and matched with the first positioning frame.

12. The button locking device of claim 11, further comprising a pair of elliptical cylinders installed at an end of the follower shaft and perpendicular to the follower shaft, and an upper slide rail and a lower slide rail installed on the panel and the bottom plate respectively and slidably matched with the elliptical cylinders.

13. The button locking device of claim 6, further comprising a circuit board installed between the panel and the bottom plate, a set numeric key, a first light signal indicator and a second light signal indicator installed on the circuit board, a set of key holes formed on the second plane of the panel and capable of installing the numeric keys, a first window formed at a top of the key holes and capable of exposing the first light signal indicator, and a second window formed at a top of the first opening and capable of exposing the second light signal indicator.

14. The button locking device of claim 13, wherein the key holes are consisted of 4~6 round holes arranged side by side with each other, and the round hole includes an axially protruding round table, and the numeric keys includes key caps slidably matched with the round hole and the round table.

15. The button locking device of claim 14, wherein the first light signal indicator includes a first group of LED lamps installed at a first flange of the circuit board and a first light guide member for accommodating the first group of LED lamps, and the second light signal indicator includes a second groups of LED lamps installed at a second flange of the circuit board and a second light guide member for accommodating the second group of LED lamps.

16. The button locking device of claim 15, wherein the first window is in a strip rectangular shape, and the second window is in a V-shape, and the first flange and the second flange are symmetrical protruding areas at a middle of the circuit board, and the first light guide member includes a first groove for accommodating the first flange and the first group of LED lamps, and a strip protrusion embeddable into the first window, and the second light guide member includes a second groove for accommodating the second flange and the second group of LED lamps and a V-shaped protrusion embeddable into the second window, and each of the first group of LED lamps and the second group of LED lamps includes a red LED lamp, a green LED lamp, and a yellow LED lamp.

17. The button locking device of claim 1, wherein the first positioning posts and second positioning posts are cross-shaped vertical ribs, and an end surface of each cross-shaped vertical rib is matched with a circular arc surface of an inner periphery of each first cylinder spring.

* * * * *